US006582019B2

(12) United States Patent
Insalaco et al.

(10) Patent No.: US 6,582,019 B2
(45) Date of Patent: Jun. 24, 2003

(54) TILT ASSEMBLY FOR A CHAIR

(75) Inventors: Robert Warren Insalaco, Holland, MI (US); Neubert Nicolai, Berlin (DE); Claudia Plikat, Berlin (DE); Johann Burkhard Schmitz, Berlin (DE); Carola E.M. Zwick, Berlin (DE); Roland R.O. Zwick, Berlin (DE)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/809,704

(22) Filed: Mar. 15, 2001

(65) Prior Publication Data

US 2001/0026089 A1 Oct. 4, 2001

Related U.S. Application Data

(60) Provisional application No. 60/190,389, filed on Mar. 17, 2000.

(51) Int. Cl.[7] ..... A47C 1/024

(52) U.S. Cl. ..... 297/300.4; 297/302.3; 297/300.1; 297/303.3

(58) Field of Search ..... 297/300.4, 302.3, 297/300.1, 300.2, 303.3

(56) References Cited

U.S. PATENT DOCUMENTS

| | | | | |
|---|---|---|---|---|
| 2,818,911 A | | 1/1958 | Syak | |
| 4,077,596 A | | 3/1978 | Pinaire et al. | |
| 4,479,679 A | | 10/1984 | Fries et al. | |
| 4,653,806 A | | 3/1987 | Willi | |
| 4,709,963 A | | 12/1987 | Uecker et al. | |
| 4,711,491 A | | 12/1987 | Ginat | |
| 4,761,033 A | | 8/1988 | Lanuzzi et al. | |
| 4,763,950 A | | 8/1988 | Tobler | |
| 4,840,426 A | | 6/1989 | Vogtherr et al. | |
| 4,892,354 A | | 1/1990 | Estkowski et al. | |
| 4,911,501 A | | 3/1990 | Decker et al. | |
| 4,966,411 A | * | 10/1990 | Katagiri et al. | 297/301 |
| 5,029,940 A | | 7/1991 | Golynsky et al. | |
| 5,046,780 A | | 9/1991 | Decker et al. | |
| 5,080,318 A | | 1/1992 | Takamatsu et al. | |
| 5,121,934 A | | 6/1992 | Decker et al. | |
| 5,224,758 A | | 7/1993 | Takamatsu et al. | |
| 5,288,138 A | | 2/1994 | Stulik et al. | |
| 5,333,368 A | | 8/1994 | Kriener et al. | |
| 5,348,372 A | | 9/1994 | Takamatsu et al. | |
| 5,397,165 A | | 3/1995 | Grin et al. | |
| 5,486,035 A | | 1/1996 | Koepke et al. | |
| 5,658,045 A | | 8/1997 | Van Koolwijk et al. | |
| 5,660,439 A | | 8/1997 | Unwalla | |
| 5,765,914 A | * | 6/1998 | Britain et al. | 297/300.4 |
| 5,806,930 A | * | 9/1998 | Knoblock | 297/300.1 |
| 5,810,440 A | | 9/1998 | Unwalla | |
| 5,909,924 A | * | 6/1999 | Roslund, Jr. | 297/300.4 |
| 5,979,984 A | | 11/1999 | DeKraker et al. | |
| 6,015,187 A | | 1/2000 | Roslund, Jr. et al. | |
| 6,086,153 A | | 7/2000 | Heidmann et al. | |

* cited by examiner

*Primary Examiner*—Peter M. Cuomo
*Assistant Examiner*—Stephanie N. Harris
(74) *Attorney, Agent, or Firm*—Brinks Hofer Gilson & Lione

(57) ABSTRACT

A tilt assembly comprising a tilt housing, a body support member pivotally attached to said tilt housing about a first horizontal axis and a spring mounted to said tilt housing at a second horizontal axis. The body support member is moveable between a first and second position. The second horizontal axis is adjustably moveable relative to the first horizontal axis. The spring biases said body support member at a first location when the body support member is in the first position and at a second location when the body support member is in the second position, with the second location being a greater distance from the first horizontal axis than the first location. A method for supporting a chair body support member is also provided. The method comprises moving the second horizontal axis to a desired position relative to the first horizontal axis, reclining the body support member, and biasing the body support member at first and second locations when the body support member is in the first and second positions respectively.

33 Claims, 6 Drawing Sheets

TILT ASSEMBLY FOR A CHAIR

This application claims the benefit of U.S. Provisional Application Ser. No. 60/190,389, filed Mar. 17, 2000, the entire disclosure of which is hereby incorporated herein by reference.

BACKGROUND

The present invention relates generally to tilt mechanisms for chairs, and in particular, to a tilt assembly, and method therefore, which provides a variable biasing force for a user as the user reclines in the chair.

Chairs of the type typically used in offices and the like are usually configured to allow tilting of a body support member, such as a seat or backrest. Often, such chairs are configured as synchrotilt chairs, wherein the backrest and seat tilt simultaneously, but at different rates. Generally, it is desirable to have the backrest tilt at a slightly greater rate so as to allow the body cavity of the chair to open.

Typically, the tilting of such office chairs is controlled by one or more springs, which act against the weight of the user and bias the seat and/or backrest in an upward direction. In general, the resistive force or moment required to support the user may increase as the user reclines in the chair, since the center of gravity of the user tends to move rearwardly as they recline.

While the resistive force of the spring can be adjusted by preloading the spring, each spring is characterized by a spring rate, or spring constant. Accordingly, preloading does not necessarily alter the characteristics of the spring in the range of tilting. Typically, the user adjusts the pre-load of the spring with an actuator, such as a knob, when the backrest and seat are in an upright position. Due to the nature of the spring, it may take a large number of turns of the actuator, e.g., in the neighborhood of 15–20 revolutions, to adjust the spring when switching from a light user to a heavier user. Moreover, as the user tilts rearwardly in the chair, the spring rate may not correspond to the force needed to counter the shift in the center of gravity of the user. Therefore, chairs often will be equipped with spring systems that are not suited for or capable of responding to the need for an increased biasing force or moment when the chair is in a more reclined position. Moreover, because of the requisite size of the springs, the mechanisms used to adjust the amount of initial resistive force or torque, i.e., preload, can be difficult to actuate, and can be progressively more difficult to adjust as higher settings are reached.

SUMMARY

Briefly stated, the invention is directed to an improved tilt assembly for a chair. In one aspect of the invention, the tilt assembly comprises a tilt housing, a body support member pivotally attached to the tilt housing about a first horizontal axis and a spring moveably mounted to said tilt housing at a second horizontal axis. The body support member, which is preferably a back support member, is moveable between at least a first and second position, with the second position being at a greater rearward tilt angle than the first position. Preferably, the second horizontal axis is adjustably moveably relative to said first horizontal axis. The spring biases the body support member at a first location when the body support member is in the first position and at a second location when the body support member is in the second position. Preferably, the second location is a greater distance from the first horizontal axis than is the first location.

In a preferred embodiment, the spring is mounted to a spring housing, which is moveably mounted to the tilt housing. In a more preferred embodiment, an adjustment mechanism is disposed in the tilt housing and engages the spring housing. The adjustment mechanism engages the spring housing and is operable to move the spring housing relative to the tilt housing. Preferably, the adjustment mechanism comprises an engagement member engaged with the spring housing and an actuation shaft threadably engaged with the engagement member.

In another aspect, a method for providing a variable biasing force for a body support member is provided. The method comprises providing a tilt housing, a body support member pivotally attached to the body support member about a first horizontal axis and a spring moveably mounted to the tilt housing at second horizontal axis spaced from said first horizontal axis. The method further preferably comprises moving the second horizontal axis to a desired position relative to the first horizontal axis, tilting the body support member from a first position to a second position, biasing the body support member with the spring at a first location when the body support member is in the first position, and biasing the body support member at a second location when the body support member is in the second position, wherein the second location is a greater distance from the first horizontal axis than is the first location.

In a preferred embodiment, the method further comprises moving the second horizontal axis from a first desired position to a second desired position relative to said first horizontal axis, wherein the first location of biasing said body support member with said spring is moved a corresponding amount.

The present invention provides significant advantages over other tilt assemblies. For example, the invention provides for a variable effective spring rate, which results in an increasing biasing moment as the user reclines in the chair. As a result, the tilt assembly is able to provide an ever increasing biasing moment to balance and offset the increasing loads applied by the user as they tilt rearwardly in the chair. In particular, the location where the spring biases the body support member moves away from the first horizontal axis about which the body support member pivots so as to thereby increase the moment arm. As a result, the moment applied by the spring about the first horizontal axis increases with the increase of the moment arm. Accordingly, the biasing moment applied to support the user is thereby increased to counter the increased moment applied by the user about the first horizontal axis as the user tilts rearwardly in the chair.

Another significant advantage of this invention is that the initial resistive force of the spring can be easily adjusted simply by moving the second horizontal axis at which the spring is mounted, relative to the first horizontal axis. This adjustment does not require prestressing the spring at differing levels. Accordingly, the adjustment mechanism, which is operable to move the second horizontal axis relative to the first horizontal axis, can be easily manipulated without progressive difficulty.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
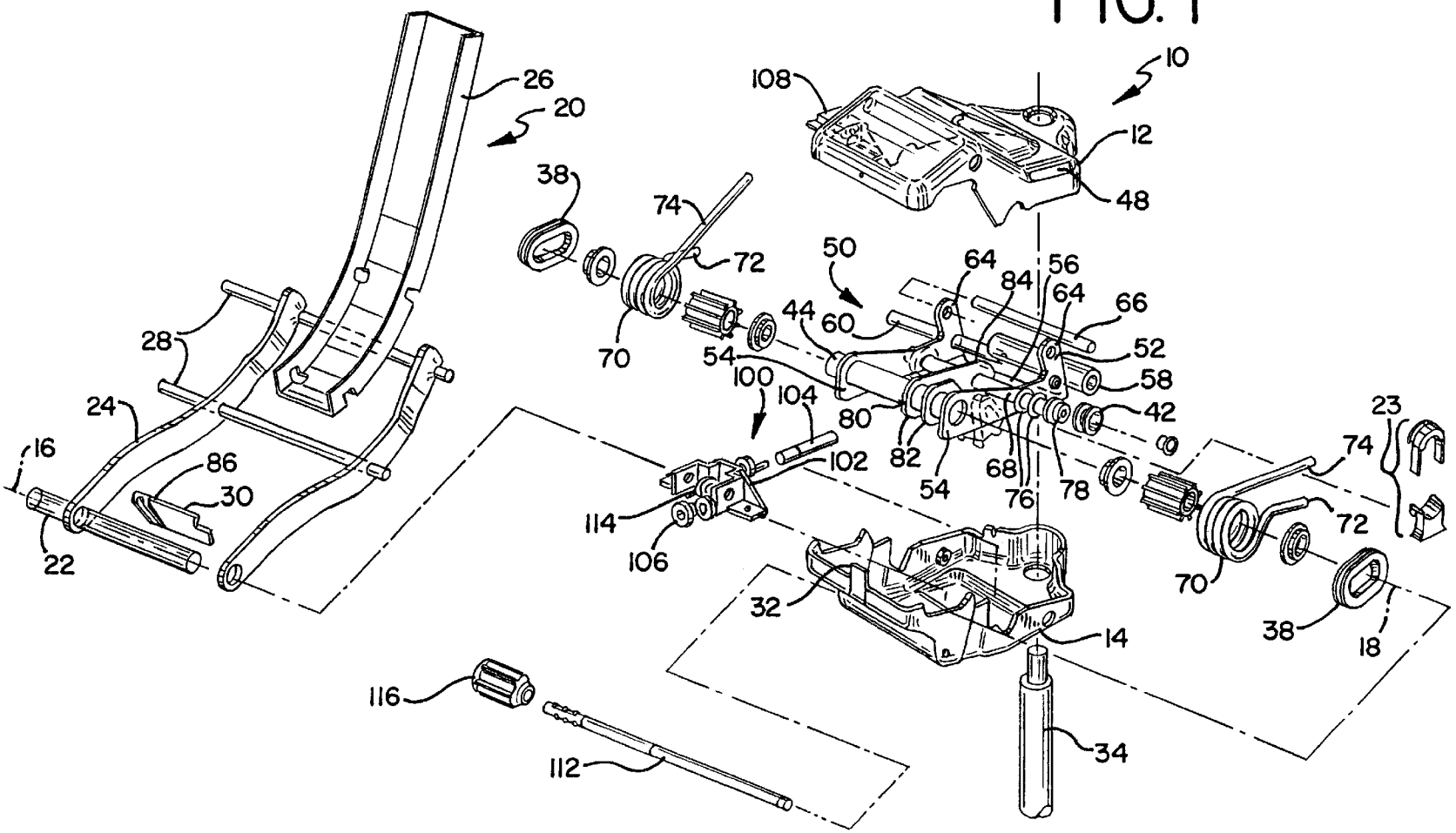
FIG. 1 is an exploded perspective view of the tilt assembly.

The terms "longitudinal" and "lateral" as used herein are intended to indicate the direction of the chair from front to back and from side to side, respectively. Similarly, the terms "front", "side", "back", "forwardly", "rearwardly", "upwardly" and "downwardly" as used herein are intended to indicate the various directions and portions of the chair as normally understood when viewed from the perspective of a user sitting in the chair.

Referring to the drawings and as best shown in FIGS. 1–3 and 5, a preferred embodiment of the tilt assembly comprising a tilt housing 10 and a body support member configured as a back support 20. The back support is pivotally attached to the tilt housing 10 about a first horizontal axis 16 with a horizontal, and laterally extending shaft 22, which defines the axis. It should be understood that the term "shaft" as used herein is meant to include both solid and hollow shafts. The back support 20 includes a pair of lower support members 24, which extend rearwardly and longitudinally from the first horizontal axis 16, and an upper support member 26. The lower support members 24 are connected to the laterally extending shaft 22 and are further connected with laterally extending cross members 28, which are preferably configured as shafts and which are spaced rearwardly from the shaft. Preferably, the lower support members 24 are welded to the shaft 22 and cross members 28. The upper support member 26 is secured to the cross members 28 and extends rearwardly and upwardly therefrom. A cover can be disposed around the back support members. A backrest, preferably including a cushion (not shown), is attached to the upper support member to provide a surface for supporting the back of a user. The back support further comprises a lever arm 30 attached to the shaft 22. The lever arm 30 extends longitudinally forward and slightly upward from the shaft 22. Preferably, the back support and lever are made of steel, although other materials, including other metals or composite materials, would also work. A molded acetal bearing 23, preferably made of acetal or like material and preferably split to facilitate installation, can be installed on the ends of the shaft 22 at the interface with the tilt housing.

Figure 6:
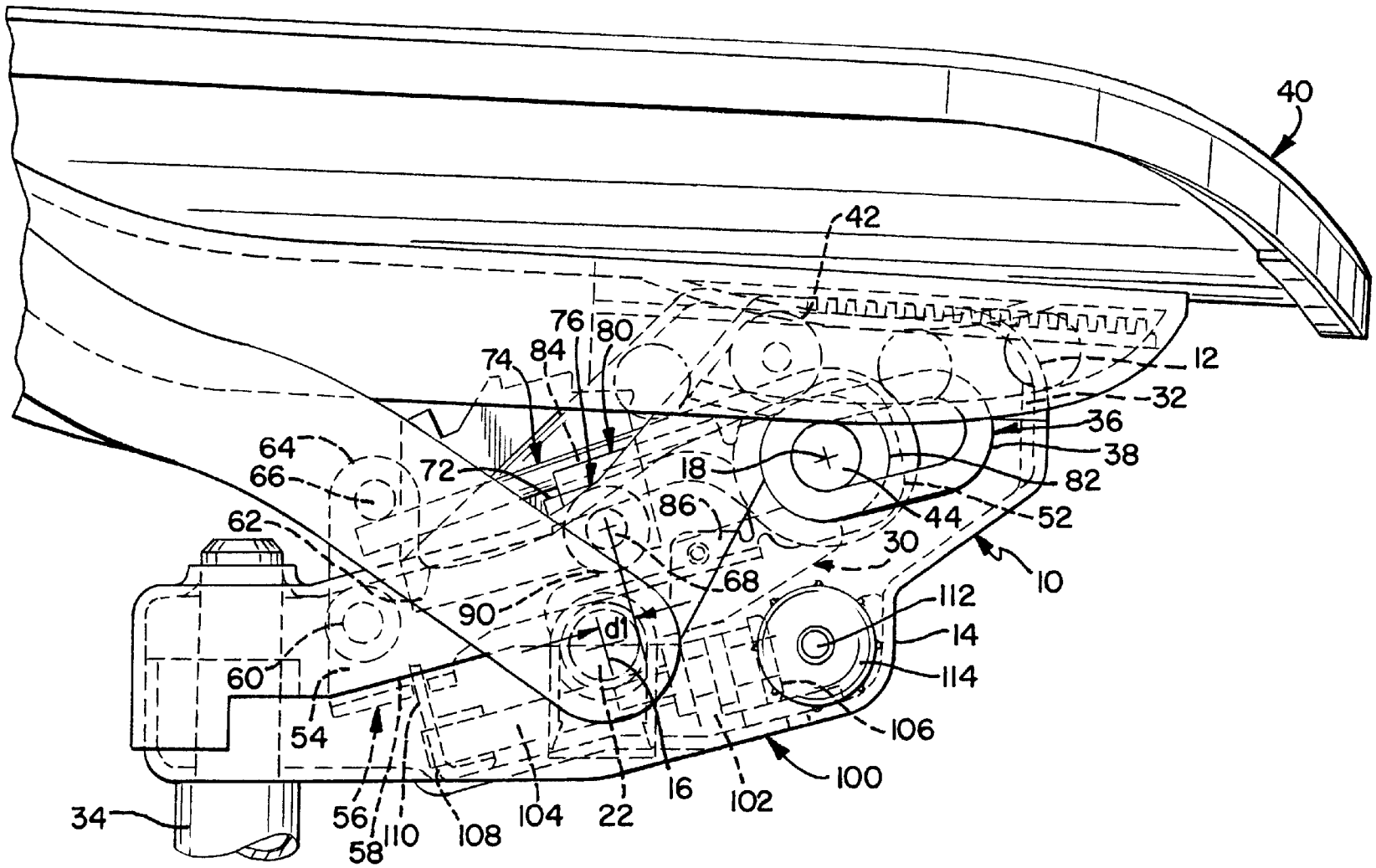
FIG. 6 is a cross-sectional side view of the tilt assembly in an upright position.
Figure 7:
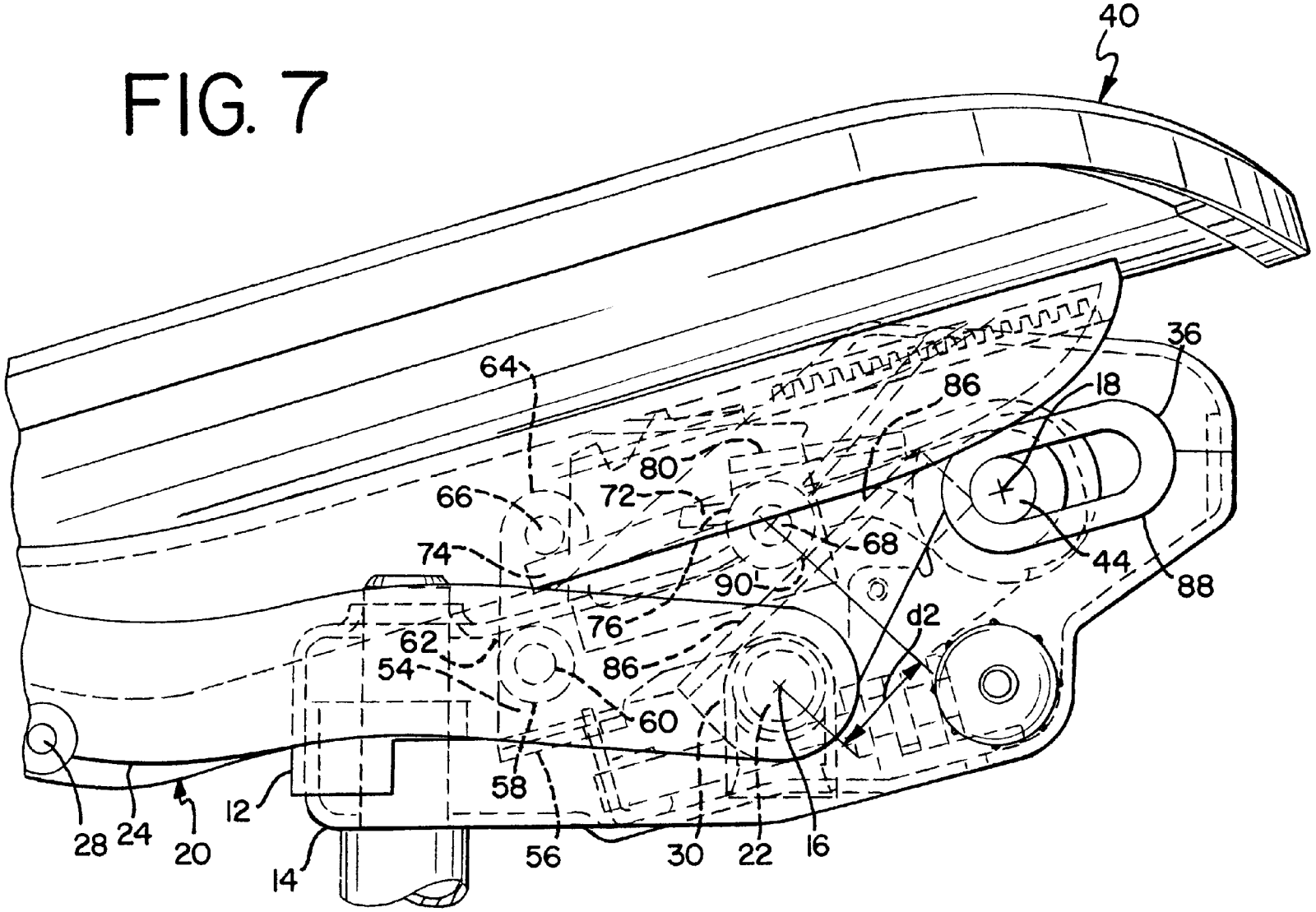
FIG. 7 is a cross-sectional side view of the tilt assembly in a reclined position.

As best shown in FIGS. 6 and 7, a second body support member 40, configured as a seat having a seat pan, is supported on a forward portion of the tilt housing 10. In particular, a pair of rollers 42 or wheels support a forward portion of the seat, while a rear portion of the seat is supported by the back support 20. Preferably, the rollers 42 are engaged with a pair of tracks formed in the seat or seat pan. In one embodiment, the rear portion of the seat is slideably supported on the cross members 28, which alternatively can be configured with rollers on the ends thereof for rolling engagement with the seat. The seat can be configured with one or more arcuate channel which receives the cross members 28, or rollers disposed thereon. In one embodiment, the channels are configured or curved to provide a virtual pivot of the seat relative to the back about the proximate hip joint of the user. Conversely, the seat can be configured with rollers, or a shaft or pin, that rollingly or slideably engage a channel or groove formed in the back support.

Figure 9:
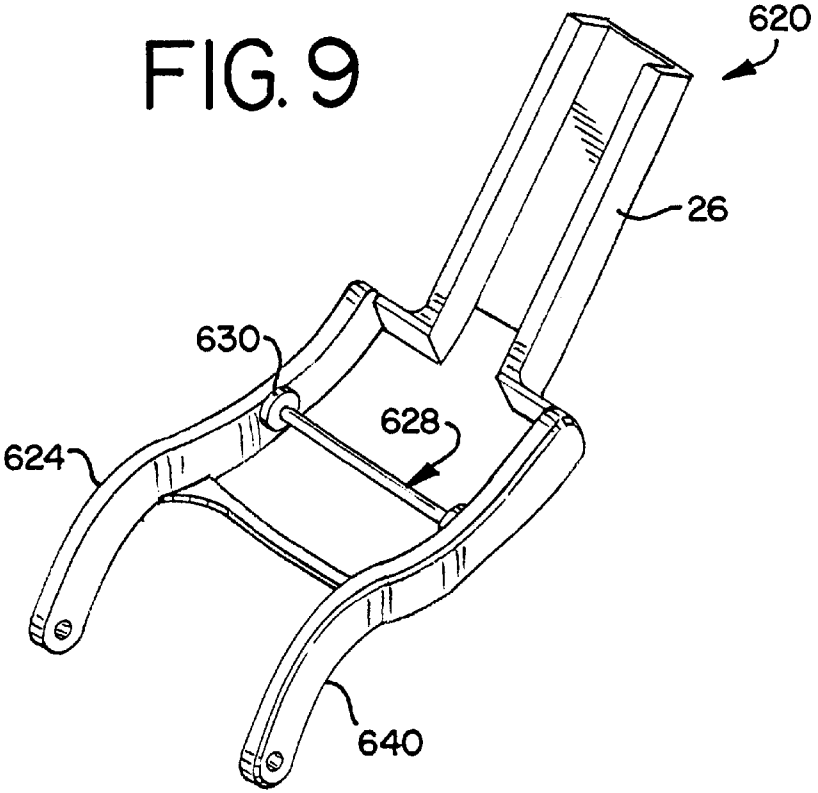
FIG. 9 is an alternative embodiment of a back support with a supporting link member.

In another embodiment, shown in FIG. 9, a rear portion of the seat is attached to a cross-member 628, preferably configured as a shaft. The ends of the shaft are supported by rollers 630, which roll, or slide, in a channel or groove formed in each of the lower support members 624 of the back support 620. A pair of links 640 each have one end connected to the cross-member 628, such that the links 640 can pivot relative to the back support, and an opposite end pivotally connected to the tilt housing 10.

Figure 8:
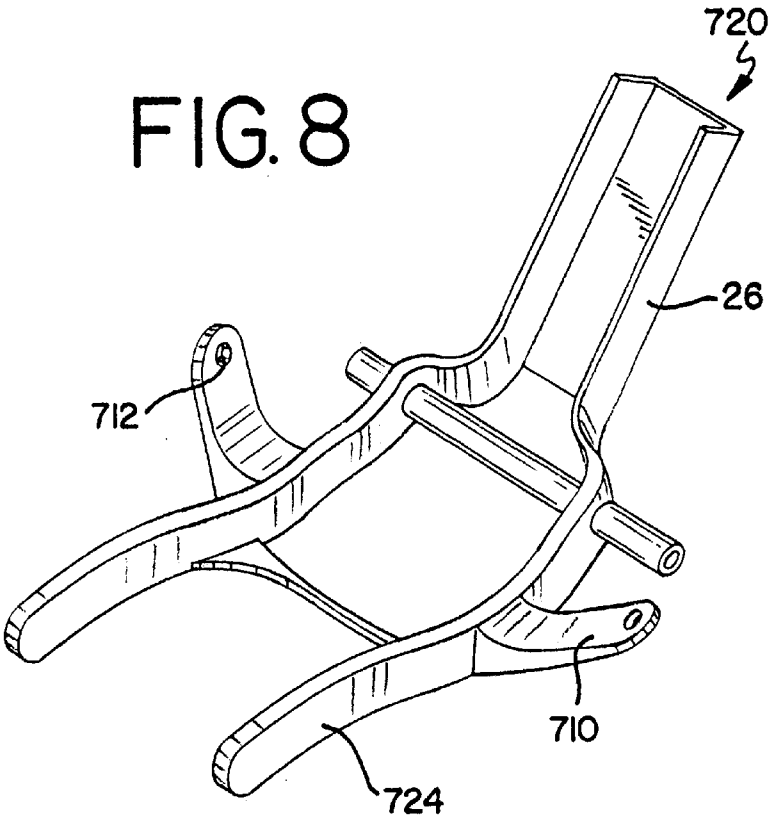
FIG. 8 is an alternative embodiment of a back support.

In alternative embodiment, shown in FIG. 8, the lower support members 724 each include a support arm 710 that extends upwardly from the lower support member. Side portions of the seat 20 are pivotally connected to the ends of the support arm 710 at a pivot axis 712 that approximates the hip pivot point.

The seat 40 preferably includes a support surface, such as a cushion, which supports the body of the user. It should be understood by one of skill in the art, that the seat body support member could also be pivotally mounted to the tilt housing, and further that the seat body support member could include a lever portion configured to be biased by a spring, rather than the back support body support member.

As best shown in FIG. 1, the tilt housing 10 preferably comprises a split tilt housing, shown as an upper and lower tilt housing 12, 14 that are mated or nested to form an enclosure therebetween. In particular, the upper tilt housing 12 overlaps the lower tilt housing 14 at a rear portion thereof, while a forward tab member 32 extends upwardly from the lower tilt housing and is nested inside the front wall of the upper tilt housing. Fasteners and the like can be used to secure the upper and lower tilt housings. Alternatively, the tilt housings can be welded, or the tilt housing can be formed as a single integral unit. In an alternative embodiment, the tilt housing can be split into a right and left housing, rather than an upper and lower housing.

Figure 2:
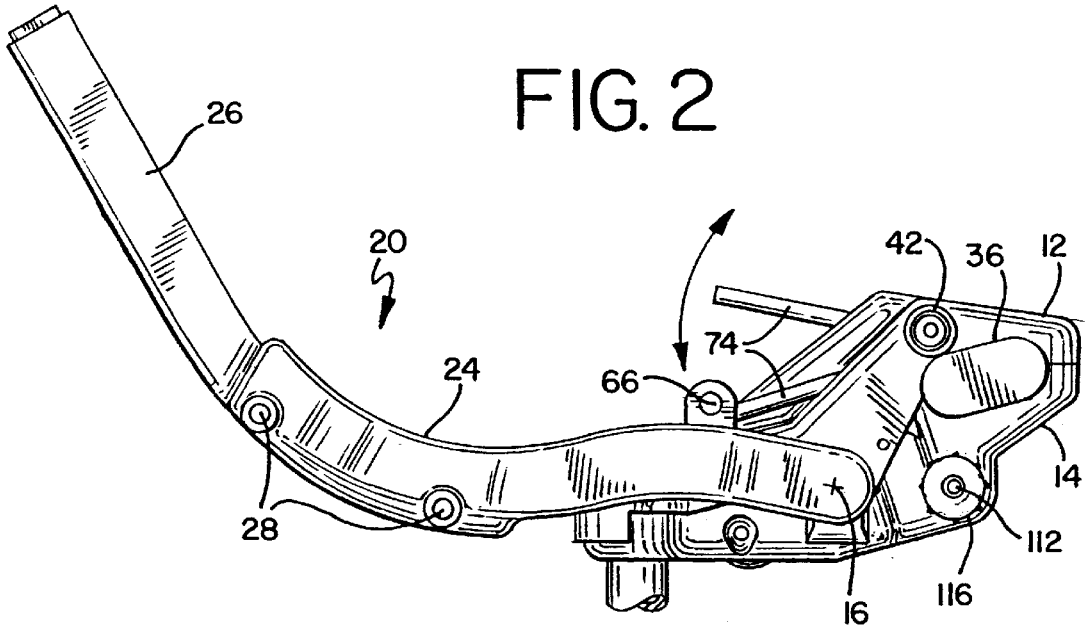
FIG. 2 is a side view of the tilt assembly.

A support column 34 is mounted to and extends upwardly through a rear portion of the tilt housing 10. As best shown in FIGS. 1 and 2, the upper and lower tilt housings 12, 14 form a longitudinally extending slot 36 therebetween along each side of the housing 10 when mated. An elliptically shaped acetal bushing 38 is mounted in the slot to provide a bearing surface. Other materials, providing a low coefficient of friction and which are wear resistant, are also acceptable and preferred, although a metal to metal surface would also work. A shaft 44 extends laterally through the tilt housing and includes opposite ends that are slideably engaged with the bushing in the slot 36. The shaft 44 defines a second horizontal axis 18. The outer portion of the bushing is closed to prevent lateral movement of the shaft in the slot of the bushing.

Figure 3:
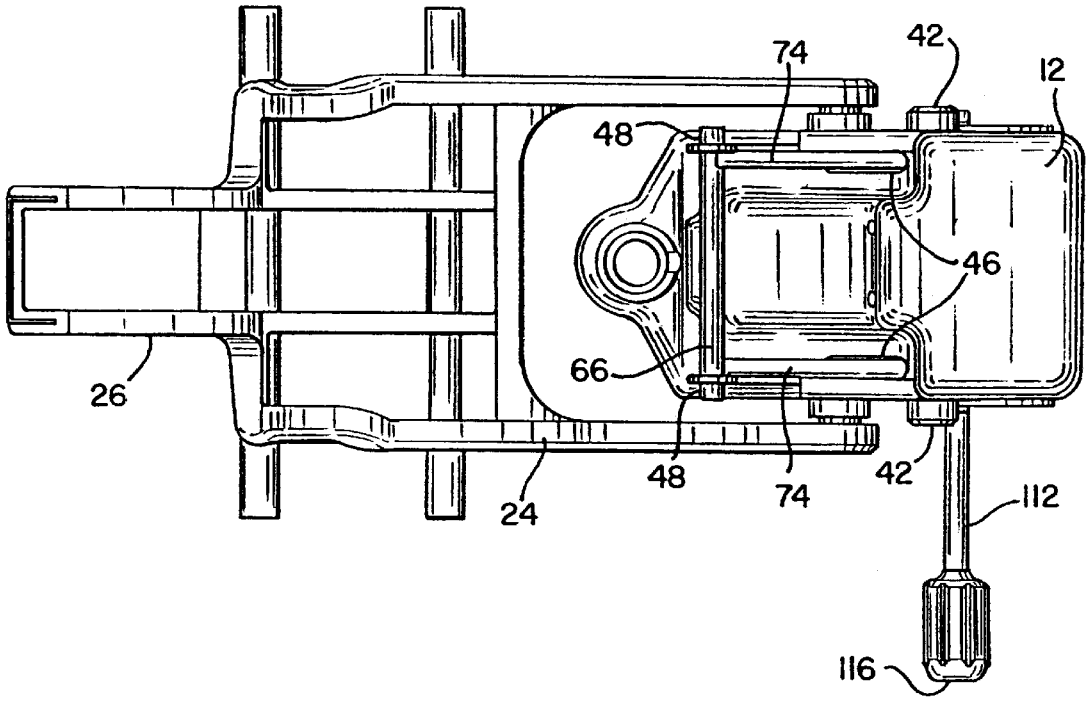
FIG. 3 is a top view of the tilt assembly.
Figure 4:
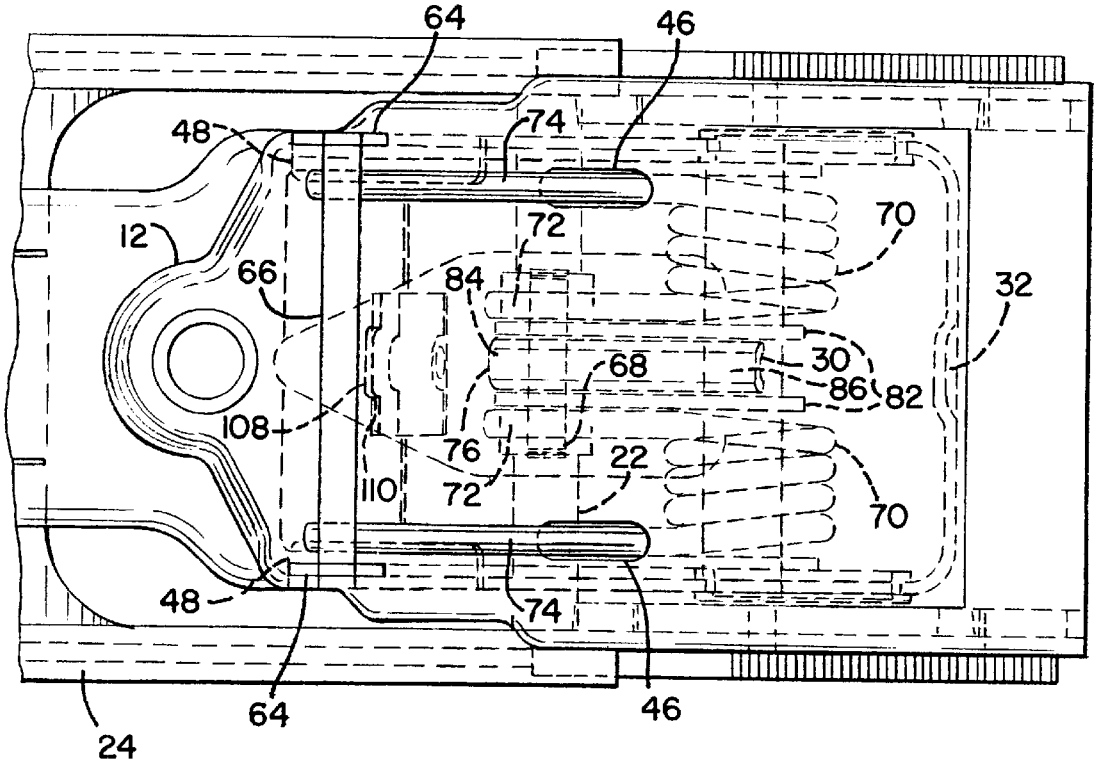
FIG. 4 is a partial top view of the tilt assembly with a seat support applied thereto.
Figure 5:
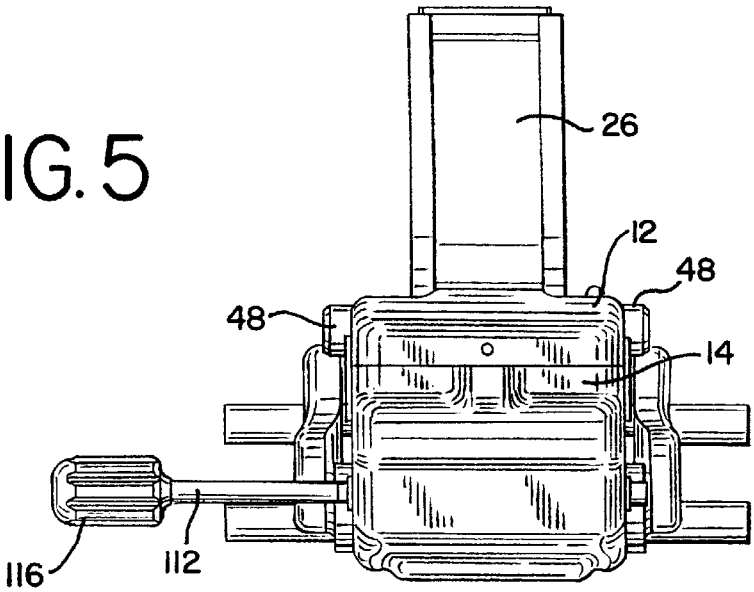
FIG. 5 is a front view of the tilt assembly.

As best shown in FIG. 3, the upper tilt housing 12 includes two pairs of openings, preferably configured as longitudinally extending slots 46, 48 formed in an upper surface thereof.

As best shown in FIGS. 1, 6 and 7, a power pack 50 is pivotally mounted to the tilt housing 10 on the shaft 44. The power pack, otherwise referred to as a spring assembly, includes a housing, otherwise referred to as a spring housing. The housing 52 comprises a pair of longitudinally extending and laterally spaced side members 54 each having a forward portion mounted on the shaft 44. A laterally extending cross member 56 extends between rear portions of the side members 54. In addition, a horizontal and laterally extending roller 58 is rotatably secured to a rear portion of the power pack housing with a shaft 60. The roller 58 engages an underside surface 62 of the upper tilt housing in a rolling engagement. One of skill in the art would understand that the roller could also be configured as a non-rotating slide member that slidably engages the underside surface or slots in the side walls of the tilt housing. As used herein, the term "slidably" is hereby defined to mean and include both a rolling contact and a non-rolling sliding contact.

The side members 54 of the spring housing further comprise an upwardly extending lug portions 64 arranged at the rear of each side member. A horizontal and laterally extending shaft 66 is removably inserted between the upwardly extending portions 64 to engage or restrain a pair of legs 74 extending from pair of springs.

As best shown in FIG. 1, a pair of coiled torsion springs 70 are disposed on a molded spring spacer, which in turn is disposed on the shaft 44, one on each side of a lever 80, which is also connected to the shaft 44. The lever 80 preferably includes a pair of lugs 82 that are mounted on the shaft, in either a fixed or pivotal relationship therewith, and an end portion 84 forming a cavity. Each spring 70 includes a pair of rearwardly extending legs 72, 74. A first leg 72 of each spring extends rearwardly and engages one end of the shaft 68. The shaft 68 extends horizontally through the end portion 84 of the lever. The first legs 72 of the springs are disposed on the top of the shaft 68 and urge the shaft 68 and lever 80 in a downward direction. A pair of caps 78, or nuts, which are preferably plastic, are affixed to the end of the shaft 68, preferably by snap fit, to prevent it from moving laterally. The lever 80 further comprises a roller 76, preferably a needle bearing roller, which is disposed on the shaft 68 in the cavity formed in the end portion 84 of the lever. The roller 76 extends radially from the end portion to provide a contact portion for the lever 80. The roller 76, or contact portion, slidably engages an upper surface 86 of the back support lever 30. Again, it should be understood that the end of the lever could be configured to simply slidably engage the back support lever 30 without the aid of a roller, but that both types of engagement are herein referred to as a slidable engagement.

Although a pair of springs is disclosed, it should be understood that a single spring would also work. Alternatively, one of skill in the art should understand that the shaft defining the second horizontal axis could be configured as a torsion bar, or that a torsilastic torsion spring could be disposed on the shaft, with the lever extending rearwardly from the shaft in either case. In yet another alternative embodiment, it should be understood that one or more cantilever springs could be affixed to the shaft, or any other structure, such as a non-circular cross member, and extend rearwardly therefrom. In such an embodiment, it should be understood that the second horizontal axis merely refers to the point of fixation for the cantilever spring, which would flex about a horizontal axis.

To assemble the tilt assembly, the back support 20 is pivotally connected to the tilt housing 10 about the first horizontal axis 16 with the shaft 22. The power pack 50, or spring assembly, is also pivotally and moveably connected to the tilt housing 10 through the slidably engagement of the shaft 44 in the slot. Preferably, the power pack is disposed on a lower track 88 of each slot 36, with the bushings 38 slid into place to engage the shaft 44. The upper tilt housing 12 is thereafter moved into place to form the slot 36 and entrap the shaft 44 between the upper and lower tilt housings 12, 14. As the upper tilt housing 12 is disposed on the lower tilt housing 14, the second legs 74 of the torsion springs 70 are fed through the first pair of openings 46 or slots formed in the upper tilt housing. Likewise, the upwardly extending lug portions 64 of the side members extend upwardly through the second pair of openings 48 or slots formed in the upper tilt housing, as shown in FIGS. 2 and 3. The ends of the second legs 74 of the springs are then rotated or pushed downwardly beneath the shaft 66, which is inserted laterally through the lug portions 64 of the spring housing side members to restrain or capture the ends of the legs. In this way, the springs are preloaded during the manufacturing process, and no further preloading is required by the user, as further explained below.

For purposes of illustration, a first spring is shown in FIGS. 2 and 3 with a second leg 74 captured by the shaft 66, while the second spring is shown with the second leg 74 in an unrestrained position. As the second legs are captured by the shaft, the springs 70 apply a load to the spring housing 50 and bias it upwardly such that the roller 58 is brought into engagement with the underside surface 62 of the upper tilt housing. At the same time, the first legs 72 of the springs bias the lever 80 downwardly as it pivots about the second horizontal axis 18. The springs 70 bias the lever 80 such that it biasingly engages the upper surface 86 of the back support lever 30. In this way, the springs 70 bias the back support member 20 in an upward direction as it pivots about and extends rearwardly from the first horizontal axis 16.

The amount of initial biasing moment applied to the back support member 20 about the first horizontal axis 16, and the corresponding force applied to the user at a set distance from that axis, is determined by the position of the power pack 50 relative to the tilt housing 10 and, in particular, by the position of the shaft 44, which defines the second horizontal axis 18, relative to the shaft 22, which defines first horizontal axis 16. To increase the moment applied by the springs 70, the user simply moves the power pack 50 forwardly in the slot 36 so as to move the point of contact between the lever 80 and the upper surface 86 of the lever 30 forwardly. When the power pack 50, or the second axis of rotation 18, is moved in this manner, the moment arm, otherwise defined as the distance between the first horizontal axis 16 and the point of contact 90 between the lever arms, is increased. It should be understood that the point of contact may be more spread out than the discrete contact between a roller and a surface, as illustrated in the figures, and may include interfacing surfaces that are in sliding contact. In any event, however, the force applied by the springs 70 will produce a greater biasing moment about the first horizontal axis 16 as the second horizontal axis 18 is moved forwardly in the tilt housing 10. In this way, the initial biasing force or biasing moment that supports the user can be easily changed simply by moving the power pack 50 within the slot 36 to a desired position, rather than by prestressing the springs. Accordingly, the biasing force can be easily adjusted, and increased, without a corresponding increase in the difficulty of manipulating the prestress of the springs.

It should be understood that the power pack could also be arranged within the tilt housing such that the springs bias the back support in an upward direction by contacting a portion of the back support members rearwardly of the first horizontal axis. In such an embodiment, the power pack would be moved rearwardly to increase the moment arm.

As best shown in FIGS. 1 and 6, a spring adjustment mechanism 100 is disposed in the tilt housing for adjusting, or moving the power pack 50 relative to the tilt housing 10. The adjustment mechanism includes a bracket 102 mounted to a bottom of the lower tilt housing 14. A longitudinally extending shaft 104 is rotatably mounted to the bracket 102 and includes a bevel gear 106 disposed on one end thereof. A nut 108, preferably an acme nut, is threadably engaged with an opposite end of the shaft 104, preferably an acme shaft, and includes an upstanding engagement member 110 that extends through an opening and engages the cross member 56 of the spring housing. A laterally extending actuation member 112, configured as a shaft, extends through a side of the tilt housing and is rotatably mounted to opposite sides of the tilt housing. The shaft also extends through openings formed in walls of the bracket 102. A second bevel gear 114 is mounted to the shaft 112 and is matingly engaged with the first bevel gear 106. A knob 116 is attached to the opposite end of the shaft 112.

In operation, the user rotates the knob 116 and shaft 112, which effects in turn a rotation of the second bevel gear 114 and a corresponding meshing and rotation of the first bevel gear 106. The rotation of the first bevel gear 106 in turn rotates the shaft 104, which threadably engages the nut 108 so as to translate the nut 108 and engagement member 110 along the length of the shaft 104. As the nut 108 is moved longitudinally within the tilt housing 10, the engagement member 110 causes the power pack housing 52 to move longitudinally relative to the tilt housing 10 as the shaft 44 slides in the slot 36 and as the rollers 58 engage the underside surface 62 of the upper tilt housing 12. Preferably, the gear ration between the bevel gears is about 1:2, such that one revolution of the knob 116 and shaft 112 corresponds to a two revolutions of the shaft 104. This relatively high ratio is achieved in part through the use of rollers and bushings interfacing between the power pack and the tilt housing.

Also in operation, the user tilts the chair and body support members 20, 40 rearwardly between an upright position, wherein the seat and back are in a normal upright position without any tilting thereof, and a fully reclined position, wherein the seat and back are at their maximum rearward tilt position, otherwise referred to as the maximum rearward tilt angle. The body support members 20, 40 pass through various intermediate reclined positions and tilt angles between the upright and fully reclined positions.

During a normal tilting action, the body support members 20, 40 are tilted between at least a first position and a second position, with the second position being at a greater rearward tilt angle than the first position. For example, the first position can correspond to the upright position, shown in FIG. 6, and the second position can correspond to the fully reclined position, shown in FIG. 7. In the first position, the lever contact roller 76 contacts the lever 30 at a first location 90 that is spaced from the first horizontal axis 16, with the distance therebetween shown as a first moment arm dl in FIG. 6. As the user tilts rearwardly to the second position, the point of contact between the lever 80 and the lever 30 moves away from the first horizontal axis 16 to a second location, which is a greater distance from the first horizontal axis 16 than is the first location. As shown in FIG. 7, for example, the lever contact portion 76 contacts the lever arm 30 at a second location 90 that is spaced from the first horizontal axis, with the distance therebetween shown as a second moment arm d2. In this way, the virtual, or effective spring rate of the springs changes as the user tilts rearwardly. In particular, the moment arm between the interface of the lever 80 and the lever arm 30 is increased such that a greater moment is applied to the body support member 20 at the first horizontal axis 16. This increased moment is able to counter the increasing moment applied by the user as the user tilts rearwardly in the chair. In other words, the tilt assembly provides an increased force applied at a fixed distance rearwardly from the first horizontal axis 16 as the user tilts rearwardly in the chair. In this way, the tilt assembly provides for an effective variable spring rate that automatically adjusts for the change in load as the user tilts rearwardly in the chair.

In a preferred embodiment, when the power pack is moved or adjusted relative to the tilt housing to a most rearward position, which would accommodate the lightest user, the lever 80 rotates the spring arm, or winds the spring, approximately 10° as the chair is tilted between the upright and maximum reclined position. When the power pack is moved relative to the tilt housing to a most forward position, which would accommodate the heaviest user, the lever 80 rotates the spring arm, or winds the spring, approximately 30°. Preferably, each spring provides an increased spring force in the range of about 18–22 lbs of force per degree of wind.

As explained above, the user can move the second horizontal axis to a desired position relative to the first horizontal axis, preferably by moving the power pack relative to the tilt housing, so as to achieve an initial biasing moment. During this adjustment, the first location, or the contact point 90, is moved a corresponding amount.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A tilt assembly for a chair comprising:

a tilt housing;

a body support member pivotally attached to the tilt housing about a first horizontal axis, said body support member moveable between at least a first position and a second position, wherein the second position is at a greater rearward tilt angle than the first position;

a spring mounted to said tilt housing at a second horizontal axis spaced apart from said first horizontal axis, wherein said second horizontal axis is adjustably moveable relative to said first horizontal axis, said spring biasing said body support member at a first location when said body support member is in said first position and at a second location when said body support member is in said second position, said second location being a greater distance from said first horizontal axis than said first location.

2. The invention of claim 1 further comprising a spring housing moveably mounted to said tilt housing, said spring mounted to said spring housing about said second horizontal axis.

3. The invention of claim 1 further comprising a shaft defining said second horizontal axis, and wherein said spring comprises a torsion spring disposed on said shaft.

4. The invention of claim 3 further comprising a lever arm extending from said shaft, wherein said spring biases said lever arm into contact with said body support member, said lever arm comprising a contact portion slidably engaging said body support member as said body support member moves between said first and second positions.

5. The invention of claim 2 further comprising an adjustment mechanism disposed in said tilt housing and engaging said spring housing, said adjustment mechanism operable to move said spring housing relative to said tilt housing.

6. The invention of claim 4 wherein said spring comprises a first leg engaged with said lever arm and a pivotally restrained second leg.

7. The invention of claim 1 wherein said tilt housing comprises a slot, and wherein said spring is mounted to a shaft, said shaft adjustably moveable within said slot.

8. The invention of claim 1 wherein said body support member comprises a back support.

9. The invention of claim 8 wherein said back support comprises a lever arm, wherein said spring biasingly acts on said lever arm of said back support.

10. The invention of claim 5 wherein said adjustment mechanism comprises an engagement member engaged with said spring housing and an actuation shaft threadably engaged with said engagement member, whereby rotation of said actuation shaft causes said engagement member to move along said actuation shaft and thereby causes said spring housing to move relative to said tilt housing.

11. The invention of claim 1 wherein said spring is a cantilever spring mounted in said tilt housing at said second horizontal axis, said cantilever spring extending rearwardly from said second horizontal axis.

12. The invention of claim 1 wherein said spring comprises a torsion spring defining said second horizontal axis.

13. A tilt assembly for a chair comprising:

a tilt housing;

a back support pivotally attached to the tilt housing about a first horizontal axis, said back support moveable between at least a first position and a second position wherein the second position is at a greater rearward tilt angle than the first position;

a power pack moveably mounted to said tilt housing, said power pack adjustably moveable relative to said tilt housing, said power pack comprising a spring having a portion biasing said back support at a first location when said back support is in said first position and at a second location when said back support is in said second position, said second location being a greater distance from said first horizontal axis than said first location, wherein said power pack and an entirety of said spring are translatably moveable relative to said tilt housing between at least a first and second position.

14. The invention of claim 13 wherein one of said tilt housing and said power pack comprises a slot and the other of said tilt housing and said power pack comprises a shaft, said shaft slidably engaged with said slot.

15. The invention of claim 13 wherein said power pack slidably engages a surface of said tilt housing.

16. The invention of claim 13 wherein said power pack comprises a housing and wherein said spring is a torsion spring having a first and second leg, wherein said first leg is pivotally restrained by said power pack housing and wherein said second leg comprises said portion biasing said back support, said spring mounted about a shaft defining a second horizontal axis.

17. The invention of claim 16 wherein said power pack further comprises a lever arm mounted to said shaft defining said second horizontal axis, said lever arm engaging said portion of said second leg of said spring, said lever arm comprising a contact portion abuttingly engaged with said back support.

18. The invention of claim 17 wherein said back support comprises a lever arm, said contact portion abuttingly engaging said lever arm of said back support.

19. A method for supporting a chair body support member, said method comprising:

providing a tilt assembly comprising a tilt housing, said body support member pivotally attached to the tilt housing about a first horizontal axis, said body support member moveable between at least a first position and a second position, wherein said second position is at a greater rearward tilt angle than said first position, and a spring mounted to said tilt housing at a second horizontal axis spaced apart from said first horizontal axis;

moving said second horizontal axis to a desired position spaced relative to said first horizontal axis;

reclining said body support member from said first position to said second position;

biasing said body support member with said spring at a first location when said body support member is in said first position and when said second horizontal axis is at said desired position; and biasing said body support member with said spring at a second location when said body support member is in said second position and when second horizontal axis is at said desired position, wherein said second location is a greater distance from said first horizontal axis than said first location.

20. The invention of claim 19 further comprising a spring housing moveably mounted to said tilt housing, said spring mounted to said spring housing about said second horizontal axis, wherein said moving said second horizontal axis comprises moving said spring housing relative to said tilt housing.

21. The invention of claim 19 wherein said spring housing comprises a shaft defining said second horizontal axis, and wherein said spring comprises a torsion spring disposed on said shaft.

22. The invention of claim 21 further comprising a lever arm pivotably mounted to said shaft, said lever arm engaging said body support member.

23. The invention of claim 22 wherein said lever arm further comprises a contact portion abuttingly engaged with said body support member, wherein said contact portion slides along said body support member between said first and second location as said body support member moves between said first and second positions.

24. The invention of claim 20 wherein said moving said spring housing comprises adjusting an adjustment mechanism engaged with said spring housing.

25. The invention of claim 24 wherein said adjustment mechanism comprises an engagement member engaged with said spring housing and an adjusting shaft threadably engaged with said engagement member, and wherein said actuating said adjusting mechanism comprises rotating said actuation shaft and thereby moving said engagement member along said actuation shaft and thereby moving said spring housing relative to said tilt housing.

26. The invention of claim 19 wherein said tilt housing comprises a slot, and wherein said spring is mounted to a shaft defining said second horizontal axis, wherein said moving said second horizontal axis spring comprises moving said shaft within said slot.

27. The invention of claim 19 wherein said body support member comprises a back support.

28. The invention of claim 27 wherein said back support comprises a lever arm, wherein said spring biasingly acts on said lever arm of said back support.

29. The invention of claim 19 wherein said spring is a cantilever spring mounted in said housing at said second horizontal axis, said cantilever spring extending rearwardly from said second horizontal axis.

30. The invention of claim 19 wherein said desired position is a first desired position, and further comprising moving said second horizontal axis from said first desired position to a second desired location, wherein said first location of said biasing said body support member with said spring is moved a corresponding amount.

31. A method for adjusting the biasing force supporting a chair body support member, said method comprising:

providing a tilt assembly comprising a tilt housing, a body support member pivotally attached to the tilt housing about a first horizontal axis, said body support member moveable between at least a first position and a second position, and a power pack comprising a housing moveably mounted to said tilt housing and a spring mounted to said power pack housing, said spring biasing said body support member at a first location spaced from said first horizontal axis when said body support member is in said first position, and thereby applying a moment to said body support member about said first horizontal axis; and moving said power pack relative to said tilt housing and thereby moving said first location relative to said first horizontal axis, wherein said moment applied by said spring to said body support member is adjusted.

32. The invention of claim 31 wherein one of said tilt housing and said power pack housing comprises a slot and the other of said tilt housing and said power pack comprises a shaft, said shaft slidably received in said slot, wherein said moving said power pack relative to said tilt housing comprises sliding said shaft in said slot.

33. The invention of claim 31 wherein said power pack further comprises a lever pivotally mounted to said power pack housing about a second horizontal axis of rotation, and wherein said spring is coaxially mounted about said second horizontal axis, said spring biasing said lever, wherein a contact portion of said lever abuttingly engages said body support member at said first location.

* * * * *